US008863705B2

(12) United States Patent
Kunert et al.

(10) Patent No.: US 8,863,705 B2
(45) Date of Patent: Oct. 21, 2014

(54) HAND-HELD POWER TOOL

(75) Inventors: Niels Kunert, Ottenbach (DE); Michael Grether, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 522 days.

(21) Appl. No.: 13/225,789

(22) Filed: Sep. 6, 2011

(65) Prior Publication Data

US 2012/0060381 A1 Mar. 15, 2012

(30) Foreign Application Priority Data

Sep. 10, 2010 (DE) ..... 10 2010 045 016

(51) Int. Cl.

| | |
|---|---|
| ***F02B 25/00*** | (2006.01) |
| ***F02B 33/04*** | (2006.01) |
| ***F02B 25/14*** | (2006.01) |
| ***F02B 25/22*** | (2006.01) |
| *F02B 75/02* | (2006.01) |
| *F02B 63/02* | (2006.01) |

(52) U.S. Cl.

CPC ..... *F02B 25/14* (2013.01); *F02B 33/04* (2013.01); *F02B 25/22* (2013.01); *F02B 2075/025* (2013.01); *F02B 63/02* (2013.01)

USPC ..... 123/73 PP

(58) Field of Classification Search

CPC .... F02B 2075/025; F02B 63/02; F02B 33/44; F02B 33/30; F02B 25/20; F02B 1/04; F02B 25/16; F02B 25/24; F02B 25/18; F02B 25/00; F02B 1/00; F02B 1/12; F02B 25/04; F02B 27/06; F02M 35/1019; F02M 35/108; F02M 35/10

USPC ..... 123/73 PP

See application file for complete search history.

(56) References Cited

U.S. PATENT DOCUMENTS

| | | | | |
|---|---|---|---|---|
| 3,945,354 | A * | 3/1976 | Johnston | 123/65 P |
| 4,195,600 | A * | 4/1980 | Shingai | 123/43 AA |
| 4,458,636 | A * | 7/1984 | Kania | 123/73 R |
| 6,668,771 | B2 * | 12/2003 | Martinsson | 123/73 A |
| 6,718,917 | B2 * | 4/2004 | Andersson et al. | 123/73 PP |
| 7,165,597 | B2 * | 1/2007 | Yamada et al. | 164/98 |
| 7,380,526 | B2 * | 6/2008 | Fattorusso | 123/73 PP |
| 7,694,943 | B2 * | 4/2010 | Mason et al. | 261/23.3 |
| 2002/0134326 | A1 * | 9/2002 | Araki | 123/73 A |

(Continued)

FOREIGN PATENT DOCUMENTS

DE 102007037009 A1 3/2008

*Primary Examiner* — Marguerite McMahon
*Assistant Examiner* — Tea Holbrook
(74) *Attorney, Agent, or Firm* — Gudrun E. Huckett

(57) ABSTRACT

A hand-held power tool has a two-stroke engine with a cylinder with combustion chamber and a piston disposed therein that drives a crankshaft supported in a crankcase. In at least one piston position, crankcase and combustion chamber are connected by a transfer passage. An air passage supplies in at least one piston position combustion air to the transfer passage. A mixture passage for fuel/air mixture is provided. Air and mixture passages in operation are at least partially connected to each other. Part of the mixture passage is formed in a carburetor where a fuel port opens into the mixture passage. The mixture passage opens into the crankcase with a piston-controlled mixture inlet having a width in circumferential direction of the cylinder. Upon upward piston stroke the mixture inlet is connected to the crankcase with a portion of the width before a connection of air passage and transfer passage is established.

19 Claims, 4 Drawing Sheets

(56) References Cited

U.S. PATENT DOCUMENTS

| | | | | |
|---|---|---|---|---|
| 2003/0029398 | A1* | 2/2003 | Andersson et al. | 123/73 PP |
| 2003/0217711 | A1* | 11/2003 | Geyer et al. | 123/73 PP |
| 2005/0284430 | A1* | 12/2005 | Yuasa et al. | 123/73 PP |
| 2006/0225677 | A1* | 10/2006 | Klimmek et al. | 123/73 PP |
| 2007/0257379 | A1* | 11/2007 | Mason et al. | 261/44.6 |
| 2010/0037874 | A1* | 2/2010 | Laydera-Collins | 123/65 P |
| 2010/0242904 | A1* | 9/2010 | Hoche et al. | 123/337 |
| 2011/0146642 | A1* | 6/2011 | Geyer et al. | 123/73 PP |

* cited by examiner

HAND-HELD POWER TOOL

BACKGROUND OF THE INVENTION

The invention relates to a hand-held power tool comprising a two-stroke engine wherein the two-stroke engine has a cylinder in which a combustion chamber is formed that is delimited by a piston. The piston drives in rotation a crankshaft that is rotatably supported in a crankcase. The crankcase in at least one position of the piston is connected by means of at least one transfer passage to the combustion chamber. An air passage for supply of combustion air is provided. A mixture passage for supply of fuel/air mixture is also provided. The air passage and the mixture passage are at least partially connected to each other in operation. A section of the mixture passage is formed in a carburetor. In the carburetor at least one fuel port opens into the mixture passage. The air passage in at least one position of the piston supplies combustion air into the at least one transfer passage. The mixture passage opens with a piston-controlled mixture inlet into the crankcase.

DE 10 2007 037 009 A1 discloses a two-stroke engine for driving the tool of a hand-held power tool wherein the intake passage is divided by a partition into an air passage and a mixture passage. It has been found that such two-stroke engines may stall when accelerating from idle.

SUMMARY OF THE INVENTION

It is an object of the present invention to provide a hand-held power tool of the aforementioned kind whose two-stroke engine has improved running behavior.

In accordance with the present invention, this is achieved in that upon upward stroke of the piston the mixture inlet across a portion of its width measured in the circumferential direction of the cylinder is connected to, or in communication with, the crankcase before the air passage connects (communicates) with the transfer passage.

At idle the throttle valve in the carburetor is only slightly open. In this throttle valve position, fuel can be supplied to the combustion chamber through the air passage as well as through the mixture passage. At full load it is desirable that the air passage opens before the mixture passage opens. Since the control times for opening the passages are constructively defined by means of the design of the ports at the cylinder bore, the air passage therefore always opens before the mixture passage. Accordingly, upon upward stroke of the piston first underpressure is applied to the air passage and only subsequently to the mixture passage. Because of this, at idle fuel from the mixture passage is sucked through the connection of the passages into the air passage and from the air passage into the transfer passages. It has been found that upon further opening of the throttle valve the mixture supply will reverse, i.e., within a narrow pivot range of a few degrees of the throttle valve the fuel is no longer supplied through the air passage and the mixture passage but substantially only through the mixture passage. The reversal of the mixture supply is realized in particular when the intermittently existing connection of the passages is closed by the throttle valve. Fuel that is supplied through the air passage reaches the transfer passages and from there flows into the combustion chamber. Fuel that is supplied through the mixture passage first reaches the crankcase and from there passes through the transfer passages into the combustion chamber. Therefore, it requires several revolutions of the crankshaft until fuel, supplied through the air passage up to this point, can pass into the combustion chamber through the mixture passage. It has been found that this short period of time in which only little fuel reaches the combustion chamber may be sufficient to cause the engine to stall.

In order to avoid this, it is now proposed that, upon upward stroke of the piston, first the mixture inlet is connected with the crankcase before the air passage connects with the transfer passage. The connection or communication should take place only about a portion of the width of the mixture inlet. In this way it is ensured that the underpressure from the crankcase first is applied to the mixture passage and only subsequently is applied to the air passage. In this way, it is achieved that even for substantially closed throttle valve mixture can be sucked in through the crankcase. The deficiency in fuel supply into the combustion chamber that occurs upon fuel supply reversal from fuel being supplied through both passages to fuel being supplied through the mixture passage can therefore be prevented by construction-based measures. Since the mixture inlet is connected only about a portion of its width with the crankcase, this is of no consequence under full load where opening of the air passage before the mixture passage opens is desirable. By opening the mixture inlet only about a portion of its width before the air passage is connected to the transfer passage, the disadvantage of insufficient mixture supply upon acceleration, observed in engines with divided intake passage, can be prevented.

Advantageously, the length of the portion of the width of the mixture inlet is approximately 10% up to approximately 80%, in particular approximately 20% up to approximately 60%, of the total width of the mixture inlet. Advantageously, the mixture inlet is connected to the crankcase with said portion of the width approximately at 1° crank angle up to approximately 5° crank angle before the air passage is connected with the transfer passage. This short duration is sufficient in order to generate in the mixture passage an underpressure so that the fuel is sucked into the mixture passage and not into the air passage. Since the mixture inlet is open only across a portion of its width and shortly after opening of the mixture inlet the air passage is connected to the transfer passage, opening of the mixture inlet before opening of the air passage to the transfer passage is of no consequence under full load so that at full load the desired function is provided. After the air passage has been connected with the transfer passage, it is provided that the mixture inlet opens across its entire width into the crankcase. The indicated sequence relates to the upward stroke of the piston, respectively. The mixture inlet opens across its entire width advantageously approximately at 0.5° crank angle up to approximately 3° crank angle after connection of the air passage with the transfer passage.

A simple constructive configuration results when the piston at its bottom edge has a cutout that connects the mixture inlet across the portion of its width with the crankcase. Advantageously, the width of the cutout, measured in circumferential direction of the piston, increases in a direction toward the crankcase. In this way, a gradual opening of the mixture inlet into the crankcase is achieved.

In addition, or as an alternative, it can be provided that the mixture inlet at its bottom edge has a depression that connects the mixture inlet across the portion of its width with the crankcase. In order to achieve a gradual opening, it is provided that the width of the depression, measured in circumferential direction of the cylinder, decreases toward the crankcase.

Advantageously, the air passage and the mixture passage across at least a section of their length extend in a common intake passage and are separated from each other by a partition. Air passage and mixture passage extend in particular commonly within the carburetor so that only a single carburetor bore and only a single throttle valve for controlling the supplied combustion air quantity are required.

Advantageously, in the carburetor a throttle valve with a throttle shaft and a choke valve with choke shaft are pivotably supported, respectively. In the carburetor a partition section of the partition is arranged in particular between the throttle valve and the choke valve. The fuel port opens advantageously into the mixture passage. By means of the partition section disposed in the carburetor a particularly excellent separation of air passage and mixture passage results. However, it can also be provided that only downstream of the throttle valve a partition between the air passage and the mixture passage is provided. In this case, the fuel port opens advantageously in the area of the intake passage that is upstream of the mixture passage. In order to achieve an excellent sealing action between the mixture passage and the air passage, it is provided that the partition section extends up to the throttle shaft. Between the partition section and the throttle shaft, there is advantageously only a small gap that is predetermined by construction measures and that, taking into consideration the existing manufacturing tolerances, ensures that the throttle shaft can rotate easily. The fuel port opens advantageously upstream of the throttle shaft into the mixture passage.

Advantageously, the piston has at least one piston recess for connecting the air passage and the transfer passage. In this connection, the piston recess connects advantageously the air passage with the transfer port. In this way, a complete scavenging of the transfer passage with scavenging air can be achieved. Advantageously, the two-stroke engine has at least one outlet-near and at least one outlet-remote transfer port wherein the outlet-near transfer port, upon upward stroke of the piston, is connected with the air passage before the outlet-remote transfer port connects with the air passage. In this way, filling of the transfer passages with scavenging air can be adjusted. This is in particular advantageous in case of transfer passages that extend underneath the outlet. With this transfer passage configuration, the outlet-near transfer passage sections are shorter than the outlet-remote transfer passage sections. Because the outlet-near transfer passage sections are connected. longer with the air passage, a uniform filling and, upon downward stroke of the piston, a uniform scavenging action of the combustion chamber can be achieved. The outlet-near transfer port is advantageously connected with the air passage after the mixture inlet has been connected across its entire width with the crankcase.

The two-stroke engine is advantageously arranged horizontally in the housing of the power tool so that the piston in the cylinder is moving approximately horizontally wherein the carburetor in the rest position of the power tool is arranged above the cylinder. In this way, there is an excellent utilization of the constructive space that is available. The mixture passage is arranged in the carburetor in particular above the air passage. This provides for an advantageous extension/configuration of the passages. The arrangement of the mixture passage above the air passage favors however as a result of the force of gravity a transfer of fuel into the air passage. In this way, the proposed opening of the mixture inlet across a portion of its width toward the crankcase before opening of the air passage is expedient in particular for two-stroke engines in which the mixture passage is arranged above the air passage. The power tool is in particular a motor chainsaw with a top handle. The horizontal arrangement of the motor and the arrangement of the carburetor above the cylinder and crankcase are particularly advantageous in such power tools.

DESCRIPTION OF THE PREFERRED EMBODIMENTS

Figure 1:
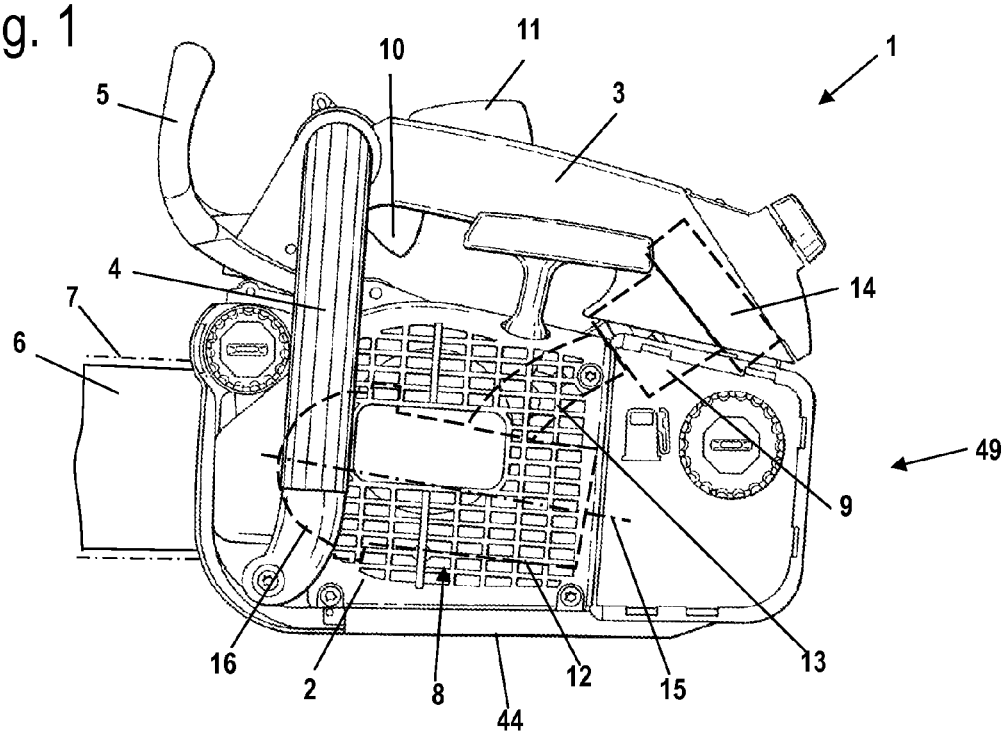
FIG. 1 is a schematics side view of a motor chainsaw.

FIG. 1 shows as an embodiment of a hand-held power tool a motor chainsaw 1. However, the two-stroke engine described in the following can also be used in other hand-held power tools such as cut-off machines, trimmers or the like. The motor chainsaw 1 has a housing 2 on which a top handle 3 as well as a lateral grip pipe 4 are secured. At the front end of the housing 2 a guidebar 6 is attached and projects forwardly. A saw chain 7, schematically indicated in FIG. 1, is arranged on the guidebar so as to circulate about it. At the front end of the grip pipe 4 a hand guard 5 is arranged that serves simultaneously as a chain brake. At the top handle 3 there is a throttle lever 10 and a throttle lever lock 11. In the housing 2 a two-stroke engine 8 is disposed. As shown in FIG. 1, the two-stroke engine 8 is positioned horizontally within the housing 2. The two-stroke engine 8 has a cylinder 12 with a longitudinal cylinder axis 15. The longitudinal cylinder axis 15 is positioned at a minimal slant relative to the bottom side 44 of the motor chainsaw 1 with which the motor chainsaw 1 is positioned on the ground. FIG. 1 shows the motor chainsaw 1 in the regular rest position 49, i.e., resting on the ground or a support surface. In this position, an intake passage 13, a carburetor 9, and an air filter 14 of the two-stroke engine 8 are arranged above the cylinder 12. As shown in FIG. 1, the crankcase 16 of the two-stroke engine 8 is positioned between cylinder 12 and front end of the housing 2 so as to face forwardly.

Figure 2:
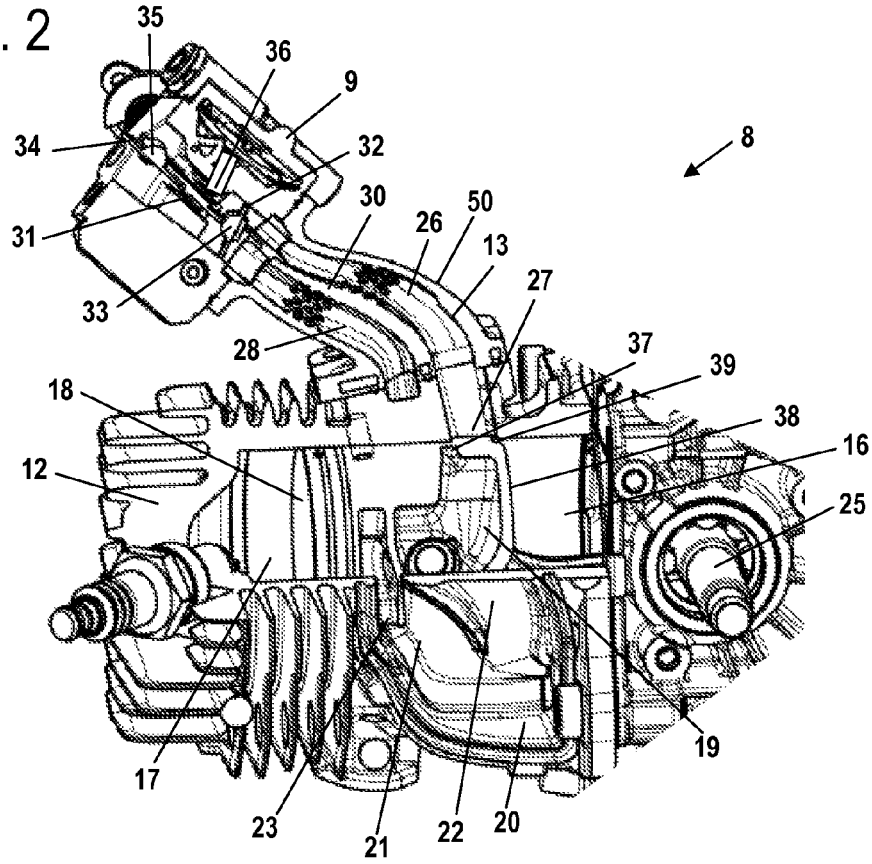
FIG. 2 is a perspective partially sectioned illustration of the two-stroke engine of the motor chainsaw of FIG. 1.

FIG. 2 shows the configuration of the two-stroke engine 8 in detail. In the cylinder 12 a piston 18 is supported that delimits a combustion chamber 17. The piston 18 drives a crankshaft 25 in rotation that is rotatably supported in crankcase 16. The two-stroke engine 8 has a carburetor 9 connected by connecting socket 50 with the cylinder 12. In the connecting socket 15 and the carburetor 9 the intake passage 13 extends that is divided by a partition 30 into an air passage 28 and a mixture passage 26. A partition section 31 is arranged in the carburetor 9 between the throttle valve 32 that is pivotably supported in the carburetor 9 and the pivotably supported choke valve 34. The throttle valve 32 is pivotably supported on a throttle shaft 33 and the choke valve 34, upstream of the throttle valve 32, is supported on a choke shaft 35. The partition section 31 extends between the choke shaft 35 and the throttle shaft 33 so that between the partition section 31 and the throttle shaft 33 or the choke shaft 35 a small gap is formed, respectively, that allows for rotation of the respective shaft. The gap intermittently provides, i.e., in a few operating states, a connection between the mixture passage 26 and the air passage 28. The connection exists in particular at idle and at low partial load. At full load, the connection is advantageously closed by the completely open throttle valve 32. In the area of the partition section 31 a fuel port 36 opens into the mixture passage 26 upstream of the throttle valve 32.

Figure 4:
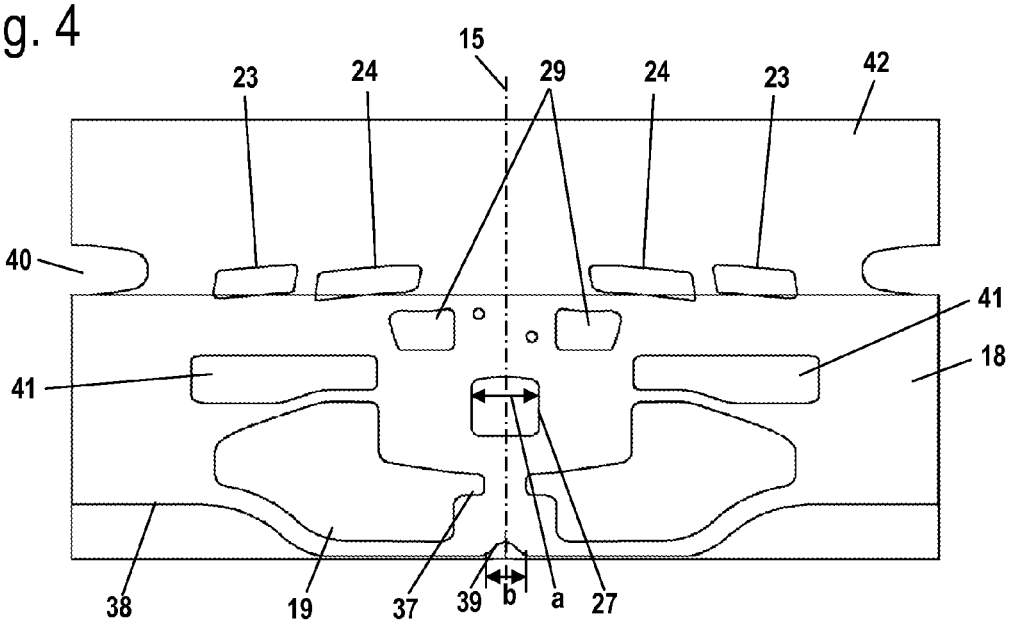
FIG. 4 shows a first developed view of cylinder and piston in a first position of the piston.

As shown also in FIG. 2, the mixture passage 26 opens with a mixture inlet 27 that is piston-controlled by piston 18 into the crankcase 16. In operation, upon upward stroke of the piston 18 toward the combustion chamber 17, fuel/air mixture flows through the mixture passage 26 and the mixture inlet 27 into the crankcase 16. Upon downward stroke of the piston 18, the mixture in the crankcase 16 is compressed. In the area of bottom dead center of the piston 18, the crankcase 16 is connected by transfer passages 20 with the combustion chamber 17. Two transfer passages 20 are arranged symmetrically on the cylinder 12 that pass with a common opening into the crankcase 16, wherein the common opening is arranged below the outlet of the two-stroke engine 12. Each transfer passage 20 extends about the cylinder 12 in a spiral shape and is divided into an outlet-near branch 21 and outlet-remote branch 22. The outlet-near branch 21 opens with transfer port 23 into the combustion chamber 17 and the outlet-remote branch 22 opens with transfer port 24 into the combustion chamber 17 (FIG. 4).

The air passage 28 is divided in the area of the cylinder 12 into two branches that each open by means of an air inlet 29 at the inner wall 42 of the cylinder 12 (FIG. 3); the air inlets 29 are piston-controlled by piston 18. The piston 18 has two piston recesses 19 that are symmetrically arranged relative to the center plane of the piston 18. The recesses 19 connect the air passage 28 in the area of top dead center of the piston 18 with the transfer ports 23 and 24. In the area of top dead center of the piston 18, scavenging air is supplied and stored in this way in the transfer passages 20; the scavenging air is advantageously substantially free of fuel. In this connection, it is also possible that through the air passage, depending on the operating state, fuel can be supplied to the two-stroke engine 12. The terms "mixture passage 26" and "air passage 28" indicate that at full load the fuel is substantially supplied through the mixture passage 26 and substantially fuel-free air is supplied through the air passage 28. Depending on the operating state, however, it can be advantageous to supply fuel also through the air passage 28. It can also be provided that rich mixture is supplied through the mixture passage 26 and lean mixture is supplied through the air passage 28.

Upon upward stroke of the piston 18 the exhaust gases are escaping from the combustion chamber 17 as soon as the outlet 40 (FIG. 4) opens. Subsequently, the scavenging air that has been stored in the transfer passages 20 flows into the combustion chamber 17 and flushes the exhaust gases out of the combustion chamber 17. Fresh mixture from the crankcase 16 flows subsequently into the combustion chamber 17.

As shown in FIG. 2, the piston recesses 19 have noses 37 that extend into the area of the mixture inlet 27 and whose function will be explained in more detail in the following. Moreover, the bottom edge 38 of the piston 18 that is facing the crankcase 16 has a cutout 39 in the area of the mixture inlet 27.

Figure 3:
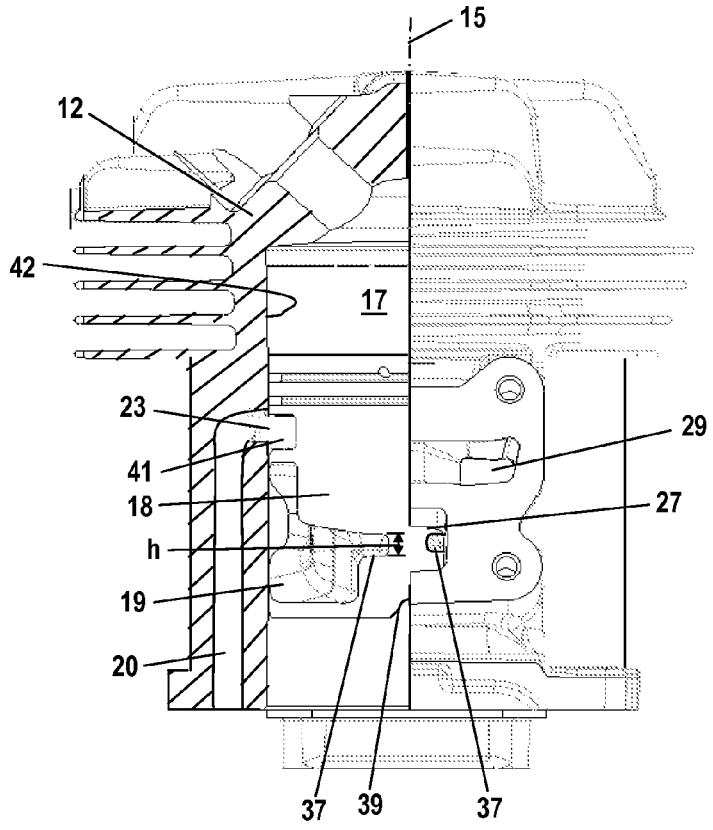
FIG. 3 is a schematic section illustration of the cylinder of the two-stroke engine of FIG. 2.

FIG. 3 shows the configuration of the cylinder 12 and of the piston 18 in detail. The transfer passage 20, for simplifying the drawing, is shown parallel to the longitudinal cylinder axis 15 even through it is extending in a spiral shape about the longitudinal cylinder axis 15.

As shown in FIG. 3, the noses 37 at the piston recesses 19 project into the area of the mixture inlet 27. In the piston position that is shown in FIG. 3, mixture can flow into the piston recesses 19 by means of the mixture inlet 27 and the noses 37 that are formed as depressions at the piston skirt and are connected to the piston recesses 19. The height h of the noses 37 measured parallel to the longitudinal cylinder axis 15 is selected such that the noses 37 are effective only in the lower engine speed range. When the engine speed of the two-stroke engine 8 drops under load from a full load situation, the fuel quantity supplied through the mixture passage 26 and the crankcase 16 may become too small so that the motor may stall. In order to prevent this, at low engine speeds additional fuel is supplied through the noses 37, the piston recess 19, and the transfer passages 20 into the combustion chamber 17. Since, as a result of dynamic throttling action at high engine speeds, the connection through the noses 37 is effective only in the low engine speed range, the exhaust gas values at high engine speeds are not worsened because of this measure.

FIG. 4 shows the piston 18 at bottom dead center. The mixture inlet 27 has a width a and the cutout 39 has a maximum width b that is advantageously approximately 10% to 80%, in particular approximately 20% to approximately 60%, of the width a. As shown in FIG. 4, the width b of the cutout 39 (measured in circumferential direction of the piston) increases in the direction toward the crankcase 16. As also shown in FIG. 4, above the piston recess 19 in the area that is passed only by the transfer ports 23 and 24 and the piston recess 19 on each piston side a pocket 41 for weight reduction is arranged. The pockets 41 are displaced slightly relative to the air inlets 29 in circumferential direction so that the air inlets 29 in no position of the piston can be in communication with the pockets 41 and a connection to the air inlets 29 can never be produced through the pockets 41.

Figure 5:
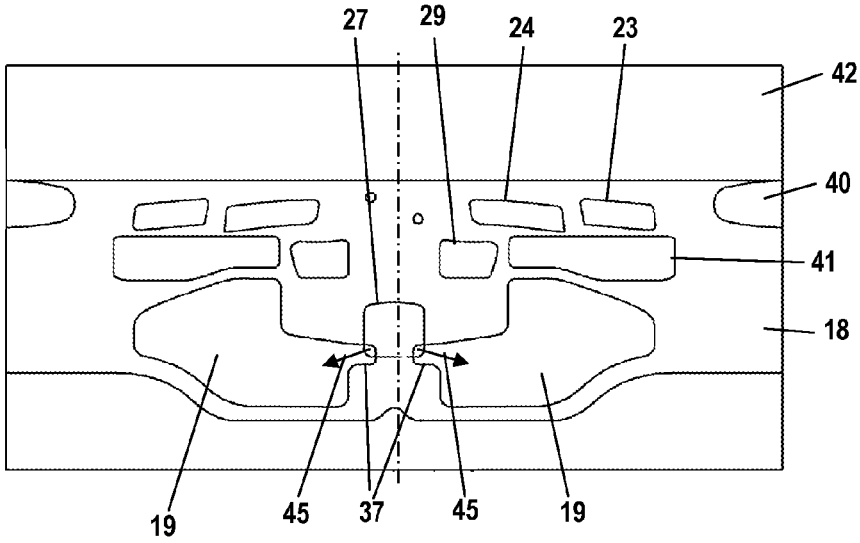
FIG. 5 shows a second developed view of cylinder and piston in a second position of the piston.

FIG. 5 shows the piston 18 moved farther upwardly with the upward stroke. In the position illustrated in FIG. 5 the noses 37 overlap the mixture inlet 27 so that from the mixture inlet 27, in direction of the arrows 45, mixture can flow into the piston recesses 19. All other openings are still closed.

Figure 6:
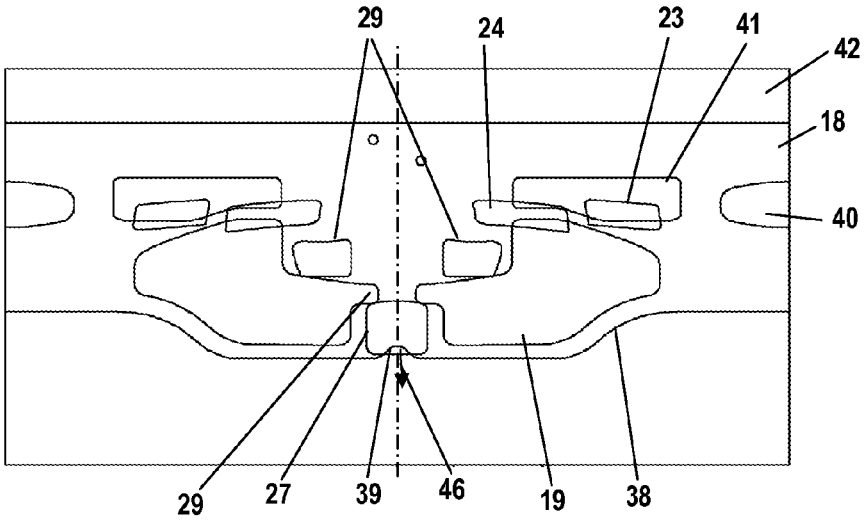
FIG. 6 shows a third developed view of cylinder and piston in a third position of the piston.

In the position illustrated in FIG. 6, the cutout 39 opens the mixture inlet 27 toward the crankcase 16 so that mixture can flow in the direction of the arrows 46 into the crankcase 16. Through this connection the underpressure that exists in the crankcase 16 can be applied to the mixture passage 26 so that it is ensured that the fuel is sucked in from the fuel port 36 into the mixture passage 26 and not into the air passage 28. As shown in FIG. 6, the air inlets 29 are still dosed relative to the piston recesses 19 in this position of the piston 18. The outlet-remote transfer ports 24 are already open relative to the piston recesses 19 while the outlet-near ports 23 are still closed.

Figure 7:
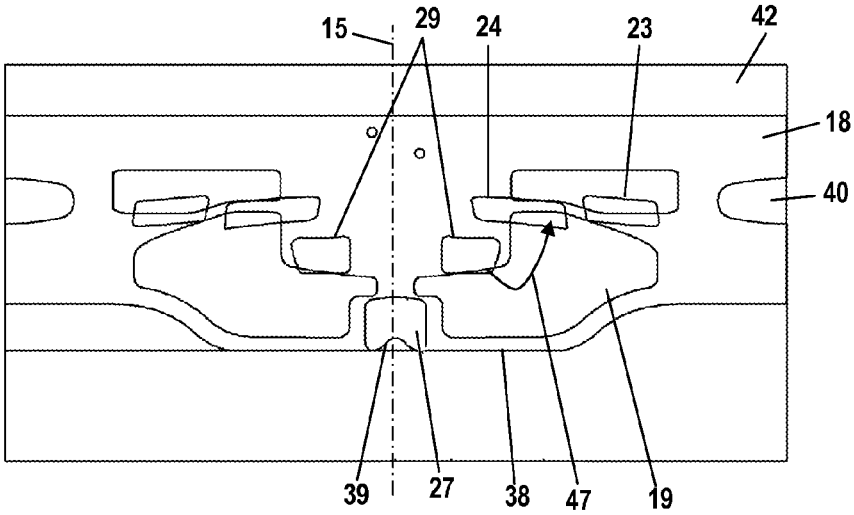
FIG. 7 shows a fourth developed view of cylinder and piston in a fourth position of the piston.

FIG. 7 shows the piston 18 in a position shortly after opening of the air inlet 29 relative to the piston recesses 19. Air from the air passage 28 flows into the transfer ports 24 and the transfer passages 20 through the piston recess 19 in the direction of arrow 47. The outlet-near transfer port 23 is still dosed. In the position illustrated in FIG. 7 the mixture inlet 27 opens across the entire width into the crankcase 16. The bottom edge 38 of the piston 18 overlaps the bottom edge of the mixture inlet 27.

Figure 8:
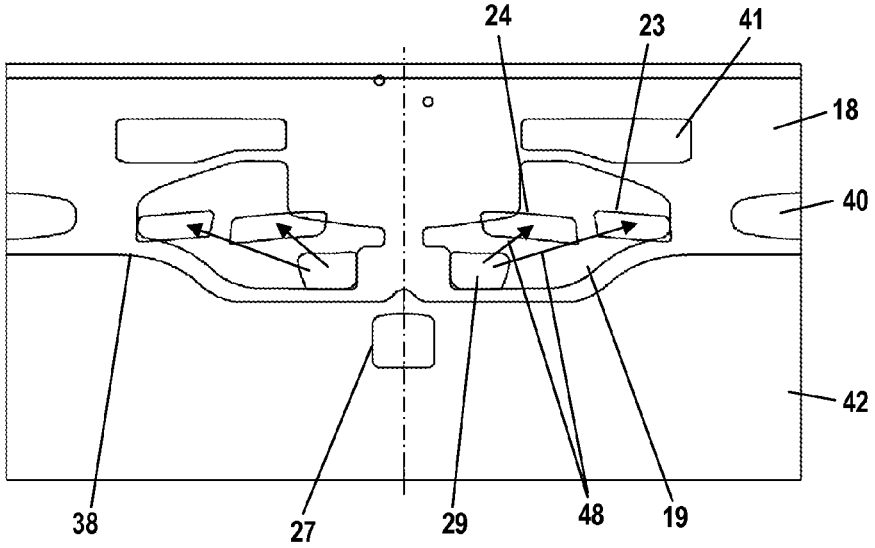
FIG. 8 shows a fifth developed view of cylinder and piston in a fifth position of the piston.

FIG. 8 shows the piston 18 at top dead center. Both transfer ports 23 and 24 are connected to the piston recess 19 wherein the upper area of the transfer port 24 has already been dosed again in order to control the air quantity supplied at the outlet-remote port. Scavenging air flows in the direction of arrows 48 out of the air inlet 29 into the transfer passages 20. The mixture inlet 27 is completely open relative to the crankcase 16.

It is provided that upon upward stroke of the piston 18 first the mixture inlet 27 is connected with the piston recess 19; then, the mixture inlet 27 is opened through the cutout 39 toward the crankcase 16; a few degrees of crank angle later, the air inlets 29 are connected through the piston recesses 19 with the outlet-remote transfer ports 24; and, subsequently, the mixture inlet 27 opens across its entire width. In this connection, the portion of the mixture inlet opens across the cutout 39 advantageously at approximately 1° crank angle up to approximately 5° crank angle before the connection of the air passage with the transfer passage is realized; the mixture inlet opens across the entire width a into the crankcase 16 advantageously at approximately 0.5° crank angle up to approximately 3° crank angle after the connection of the air passage with the transfer passage 20 is realized. The outlet-near transfer passage opens relative to the piston recess 19 advantageously at approximately 2° crank angle up to approximately 10° crank angle after opening of the mixture inlet 27 across its entire width a.

Figure 9:
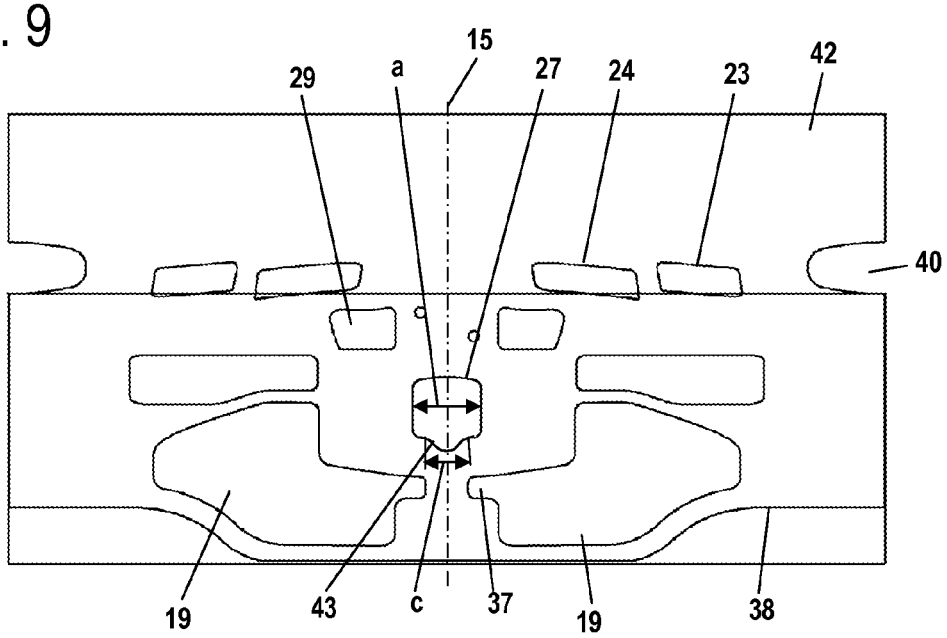
FIG. 9 is a developed view of a cylinder and piston of another embodiment.

FIG. 9 shows an embodiment wherein same reference numerals indicate the same elements as in the preceding Figures. The embodiment illustrated in FIG. 9 shows that the bottom edge 38 of the piston 18 in the area of the mixture inlet 27 is of a straight configuration and extends perpendicularly to the longitudinal cylinder axis 15. The bottom edge of the mixture inlet 27 has a depression 43 that extends in the direction toward the crankcase 16. The width c of the depression 43 (measured in the circumferential direction of the cylinder) decreases in the direction toward the crankcase 16. The dimensions of the depression 43 matches advantageously those of the cutout 39. The width c of the depression 43 is therefore advantageously approximately 10% up to approximately 80% of the entire width a of the mixture inlet 27. By means of the depression 43 the same effect is achieved as with the cutout 39 at the piston 18. The underpressure of the crankcase 16 is first applied to the mixture passage 26 so that the fuel is sucked in from the fuel port 36 into the mixture passage 27 and not into the air passage 28. Also, a combination of the cutout 39 and the depression 43 can be advantageous.

In the illustrated embodiment, a hand-held power tool is shown whose intake passage is extending in the carburetor as a channel that is divided by a partition 30 into an air passage 28 and a mixture passage 26. The proposed connection of the mixture inlet with the crankcase can be expedient however also in two-stroke engines in which air passage and mixture passage are only partially connected with each other, for example, in certain operating states or only across a short section of an engine cycle. The connection of the passages can also be provided, for example, by means of special connecting openings or the like so that the passages across the entire length are separated from each other and, for example, in the area of the throttle element, are connected in a defined fashion. The throttle element can also be, for example, in the form of a barrel that controls a corresponding connection.

The specification incorporates by reference the entire disclosure of German priority document 10 2010 045 016.2 having a filing date of Sep. 10, 2010.

While specific embodiments of the invention have been shown and described in detail to illustrate the inventive principles, it will be understood that the invention may be embodied otherwise without departing from such principles.

What is claimed is:

1. A hand-held power tool comprising:

a two-stroke engine comprising a cylinder with a combustion chamber and a piston disposed in said cylinder and delimiting said combustion chamber;

said two-stroke engine comprising a crankcase and a crankshaft that is rotatably supported in said crankcase and driven in rotation by said piston, wherein in at least one position of said piston said crankcase is connected by a transfer passage to said combustion chamber;

said two-stroke engine comprising an air passage for supply of combustion air and a mixture passage for supply of fuel/air mixture, wherein said air passage and said mixture passage in operation are at least partially connected to each other;

said two-stroke engine comprising a carburetor, wherein a section of said mixture passage is formed in said carburetor and wherein in said carburetor at least one fuel port is provided that opens into said mixture passage;

wherein said piston has at least one piston recess for connecting said air passage and said transfer passage;

wherein said air passage in at least one position of said piston supplies combustion air to said transfer passage;

wherein said mixture passage has a mixture inlet and opens into said crankcase with said mixture inlet that is piston-controlled by said piston;

wherein said mixture inlet has a total width extending in a circumferential direction of said cylinder, wherein, upon upward stroke of said piston, said mixture inlet is connected to said crankcase with only a portion of said total width before a connection of said air passage to said transfer passage is established, wherein said portion of said total width is 10% up to 80% of said total width.

2. The power tool according to claim 1, wherein said mixture inlet with said portion of said total width is connected to said crankcase at 1° crank angle up to 5° crank angle before said connection of said air passage to said transfer passage is established.

3. The power tool according to claim 1, wherein said mixture inlet opens completely across said total width into said crankcase after said connection of said air passage to said transfer passage has been established.

4. The power tool according to claim 3, wherein said mixture inlet opens completely across said total width at 0.5° crank angle up to 3° crank angle after said connection of said air passage to said transfer passage has been established.

5. The power tool according to claim 1, wherein said two-stroke engine has a common intake passage, wherein said air passage and said mixture passage extend at least partially together in said common intake passage and are separated by a partition disposed in said common intake passage.

6. The power tool according to claim 5, wherein in said carburetor a throttle valve with a throttle shaft and a choke valve with a choke shaft are pivotably supported, respectively, wherein a partition section of said partition is arranged in said carburetor between said throttle valve and said choke valve.

7. The power tool according to claim 6, wherein said partition section extends up to said throttle shaft.

8. The power tool according to claim 6, wherein said at least one fuel port opens upstream of said throttle shaft into said mixture passage.

9. The power tool according to claim 1, wherein said transfer passage has a transfer port that opens into said combustion chamber.

10. The power tool according to claim 9, wherein said two-stroke engine has a first one of said transfer port and a second one of said transfer port, wherein said first transfer port is outlet-near and said second transfer port is outlet-remote, wherein said first transfer port, upon upward stroke of said piston, is connected to said air passage before said second transfer port is connected to said air passage.

11. The power tool according to claim 10, wherein said first transfer port is connected to said air passage after said mixture inlet opens completely across said total width into said crankcase.

12. The power tool according to claim 1, comprising a housing, wherein said two-stroke engine is arranged horizontally in said housing, wherein said carburetor in a regular rest position of the power tool is arranged above said cylinder.

13. The power tool according to claim 12, wherein said mixture passage is disposed in said carburetor above said air passage when the power tool is in said regular rest position.

14. The power tool according to claim 1, in the form of a motor chainsaw with a top handle.

15. A hand-held power tool, comprising:

a two-stroke engine comprising a cylinder with a combustion chamber and a piston disposed in said cylinder and delimiting said combustion chamber;

said two-stroke engine comprising a crankcase and a crankshaft that is rotatably supported in said crankcase and driven in rotation by said piston, wherein in at least one position of said piston said crankcase is connected by a transfer passage to said combustion chamber;

said two-stroke engine comprising an air passage for supply of combustion air and a mixture passage for supply of fuel/air mixture, wherein said air passage and said mixture passage in operation are at least partially connected to each other;

said two-stroke engine comprising a carburetor, wherein a section of said mixture passage is formed in said carburetor and wherein in said carburetor at least one fuel port is provided that opens into said mixture passage;

wherein said piston has at least one piston recess for connecting said air passage and said transfer passage;

wherein said air passage in at least one position of said piston supplies combustion air to said transfer passage;

wherein said mixture passage has a mixture inlet and opens into said crankcase with said mixture inlet that is piston-controlled by said piston;

wherein said mixture inlet has a width extending in a circumferential direction of said cylinder, wherein, upon upward stroke of said piston, said mixture inlet is connected to said crankcase with a portion of said width before a connection of said air passage to said transfer passage is established;

wherein said piston has a bottom edge facing away from said combustion chamber, wherein said bottom edge has a cutout that connects said mixture inlet across said portion of said width to said crankcase.

16. The power tool according to claim 15, wherein said portion of said width is 10% up to approximately 80% of said width.

17. The power tool according to claim 15, wherein said cutout has a width in a circumferential direction of said piston that increases in a direction toward said crankcase.

18. A hand-held power tool, comprising:

a two-stroke engine comprising a cylinder with a combustion chamber and a piston disposed in said cylinder and delimiting said combustion chamber;

said two-stroke engine comprising a crankcase and a crankshaft that is rotatably supported in said crankcase and driven in rotation by said piston, wherein in at least one position of said piston said crankcase is connected by a transfer passage to said combustion chamber;

said two-stroke engine comprising an air passage for supply of combustion air and a mixture passage for supply of fuel/air mixture, wherein said air passage and said mixture passage in operation are at least partially connected to each other;

said two-stroke engine comprising a carburetor, wherein a section of said mixture passage is formed in said carburetor and wherein in said carburetor at least one fuel port is provided that opens into said mixture passage;

wherein said piston has at least one piston recess for connecting said air passage and said transfer passage;

wherein said air passage in at least one position of said piston supplies combustion air to said transfer passage;

wherein said mixture passage has a mixture inlet and opens into said crankcase with said mixture inlet that is piston-controlled by said piston;

wherein said mixture inlet has a width extending in a circumferential direction of said cylinder, wherein, upon upward stroke of said piston, said mixture inlet is connected to said crankcase with a portion of said width before a connection of said air passage to said transfer passage is established;

wherein said mixture inlet has a bottom edge facing away from said combustion chamber, wherein said bottom edge has a depression that connects said mixture inlet across said portion of said width to said crankcase.

19. The power tool according to claim 18, wherein said depression has a width in a circumferential direction of said cylinder that decreases in a direction toward said crankcase.

* * * * *